US007537143B1

(12) United States Patent
Collier

(10) Patent No.: US 7,537,143 B1
(45) Date of Patent: May 26, 2009

(54) BACKPACK WITH EXTERNAL FRAME

(75) Inventor: Michael Collier, Portland, OR (US)

(73) Assignee: NIKE, Inc., Beaverton, OR (US)

( * ) Notice: Subject to any disclaimer, the term of this patent is extended or adjusted under 35 U.S.C. 154(b) by 411 days.

(21) Appl. No.: 10/682,810

(22) Filed: Oct. 9, 2003

(51) Int. Cl.
*A45F 3/08* (2006.01)
*A45F 3/10* (2006.01)

(52) U.S. Cl. ..... 224/633; 224/637

(58) Field of Classification Search ..... 224/627–629, 224/631–636, 148.6, 576, 160, 153, 584, 224/585, 913, 916, 648, 649, 637, 650, 155; 2/463, 467; 383/119
See application file for complete search history.

(56) References Cited

U.S. PATENT DOCUMENTS

| | | | | | |
|---|---|---|---|---|---|
| 4,214,685 | A * | 7/1980 | Pletz | 224/634 |
| 4,861,803 | A * | 8/1989 | Turner | 521/37 |
| 5,160,073 | A * | 11/1992 | Bateman | 224/636 |
| 5,187,005 | A * | 2/1993 | Stahle et al. | 442/208 |
| 5,354,532 | A * | 10/1994 | Nakai et al. | 264/259 |
| 5,533,748 | A * | 7/1996 | Wirt et al. | 280/728.3 |
| 5,617,984 | A * | 4/1997 | Fabel | 224/641 |
| 5,890,640 | A * | 4/1999 | Thompson | 224/630 |
| 6,024,265 | A * | 2/2000 | Clements | 224/630 |
| 6,098,859 | A * | 8/2000 | Bortner | 224/272 |
| 6,106,235 | A * | 8/2000 | Tettenborn et al. | 416/229 R |
| 6,179,186 | B1 | 1/2001 | Blanking | |
| 6,276,584 | B1 * | 8/2001 | McLachlan | 224/637 |
| 6,629,629 | B2 * | 10/2003 | Lee et al. | 224/583 |
| 6,886,727 | B2 * | 5/2005 | Moore | 224/637 |
| 6,892,915 | B2 * | 5/2005 | Mares | 224/630 |
| 2002/0162871 | A1 * | 11/2002 | Vigny | 224/628 |
| 2006/0011689 | A1 * | 1/2006 | Reid | 224/637 |

FOREIGN PATENT DOCUMENTS

| | | | |
|---|---|---|---|
| FR | 2814349 | A1 * | 3/2002 |
| GB | 2328147 | A * | 2/1999 |

* cited by examiner

*Primary Examiner*—Nathan J Newhouse
*Assistant Examiner*—Justin M Larson
(74) *Attorney, Agent, or Firm*—Banner & Witcoff, Ltd.

(57) ABSTRACT

A backpack includes a bag having a body side and an outer side. A frame extends over and is secured to an exterior surface of the outer side. The frame includes an elastomeric central hub and a plurality of frame members, each of which is secured to the central hub and extends across a portion of the body side. A resilient support member may be secured to a lower surface of the frame. Each of a pair of shoulder straps is secured at their respective upper ends to an upper portion of the bag and at their respective lower ends to a lower portion of the bag.

26 Claims, 3 Drawing Sheets

BACKPACK WITH EXTERNAL FRAME

FIELD OF THE INVENTION

This invention relates generally to backpacks, and, in particular, to backpacks with external frames.

BACKGROUND OF THE INVENTION

Backpacks for carrying items such as books, clothing, and other personal items are well known. Backpacks typically comprise a large central compartment into which the items are placed. Additional compartments and pockets may also be provided to separate items within the backpack. The backpack is typically outfitted with a pair of shoulder straps, and may also have a hip strap, opposed ends of which are attached to the backpack, and are used by the wearer to carry the backpack.

Such backpacks may be frameless and rely solely on the shoulder straps, hip strap and bag to support the contents of the pack. Other backpacks may include an internal or external frame. It is preferable for the weight of a pack to be carried by the hips or by the sacrum. However, frameless backpacks do not allow the weight of the backpack to be effectively transferred to the user's hips, and provide little protection for the contents of the backpack. Along with the heavier loads being carried more frequently by frameless packs comes the increased potential for fatigue, discomfort, poor posture, and even musculoskeletal disorder and injury. This places a premium on backpack design to minimize such potential. However, the suspension systems in many such backpacks are simply incapable of providing an ergonomically correct fit. A backpack with standard shoulder straps primarily carries the load on the shoulders. However, the more a load can ride on the hips, the less load pressure there is on the shoulders. Further, the closer the load is to the back of the user, the more upright the user is able to walk, and, consequently, there is less pressure on the hip joints.

Known backpacks with internal or external frames allow the weight of the backpack to be carried by the user's hips, but typically do not provide much protection for the contents of the backpack. Some backpacks are formed of a dimensionally stable material, e.g., plastic. However, such backpacks can present problems to the user, since it can be uncomfortable to have a hard plastic backpack directly against one's back.

Other known backpacks are limiting in that their shells do not provide any resiliency or torsional flexibility. Rigid backpacks cannot be compressed at all, and, therefore the contents of the backpack may get tossed and turned as the user moves. Further, a rigid backpack provides no absorption of shocks when the backpack is set down by the user, potentially leading to disruption and/or damage of its contents.

It is an object of the present invention to provide a backpack with an external frame that reduces or overcomes some or all of the difficulties inherent in prior known devices. Particular objects and advantages of the invention will be apparent to those skilled in the art, that is, those who are knowledgeable or experienced in this field of technology, in view of the following disclosure of the invention and detailed description of certain preferred embodiments.

SUMMARY

In accordance with a first aspect, a backpack includes a bag having a body side and an outer side. A frame extends over and is secured to an exterior surface of the outer side. The frame includes an elastomeric central hub and a plurality of frame members. Each frame member is secured to the central hub and extends across a portion of the body side. An upper end of each strap of a pair of shoulder straps is secured to an upper portion of the bag, and a lower end of each shoulder strap is secured to a lower portion of the bag.

In accordance with another aspect, a backpack includes a bag having a body side and an outer side. A frame extends over and is secured to an exterior surface of the outer side and includes a plurality of frame members extending across a portion of the body side. A resilient support member is secured to a lower surface of the frame. An upper end of each strap of a pair of shoulder straps is secured to an upper portion of the bag, and a lower end of each shoulder strap is secured to a lower portion of the bag.

In accordance with a further aspect, a backpack includes a bag having a body side, an outer side, and a pair of hip portions extending from lower portions of the body side. A frame extends over and is secured to an exterior surface of the outer side. The frame includes an elastomeric central hub and a plurality of frame members. Each frame member is co-molded to the central hub and extends across a portion of the body side. A resilient support member is secured to a lower surface of the frame. An upper end of each strap of a pair of shoulder straps is secured to an upper portion of the bag, and a lower end of each shoulder strap is secured to a lower portion of the bag. A hip strap is connected at opposite ends thereof to corresponding hip portions.

Substantial advantage is achieved by providing a backpack with an external frame. In particular, backpacks with external frames in accordance with the present invention provide protection from impact for the contents of the pack, while still providing en enough flexibility in the pack to allow for compression of the bag and a resilient resistance to impacts. Further backpacks in accordance with the present invention provide shock absorbing capability for the bottom of the backpack.

These and additional features and advantages of the invention disclosed here will be further understood from the following detailed disclosure of certain preferred embodiments.

Figure 1:
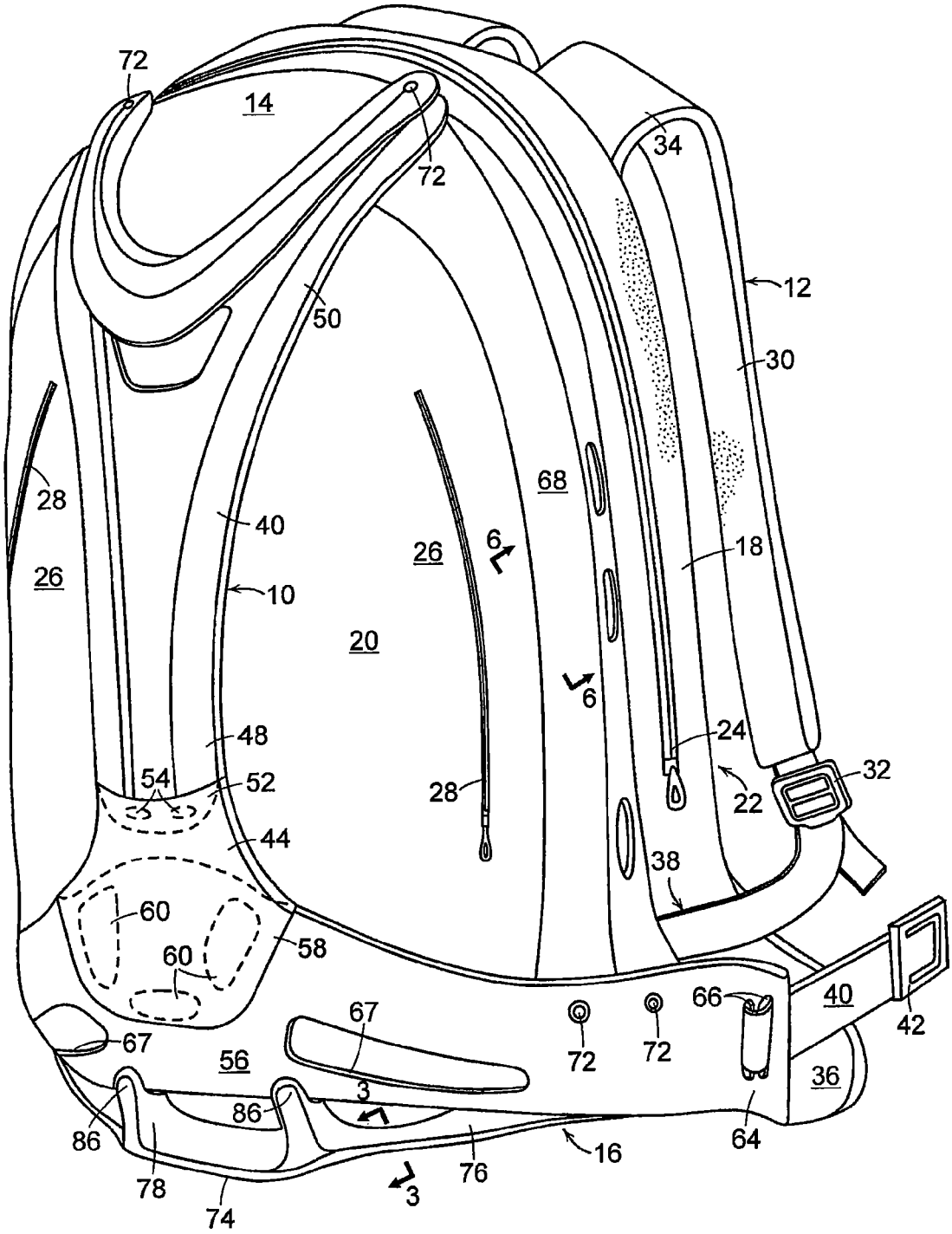
FIG. 1 is a perspective view of an external frame for a backpack in accordance with a preferred embodiment of the present invention, shown installed on a backpack.

The figures referred to above are not drawn necessarily to scale and should be understood to present a representation of the invention, illustrative of the principles involved. Some features of the backpack with external frame depicted in the drawings have been enlarged or distorted relative to others to facilitate explanation and understanding. The same reference numbers are used in the drawings for similar or identical components and features shown in various alternative embodiments. Backpacks with external frames as disclosed herein, would have configurations and components determined, in part, by the intended application and environment in which they are used.

DETAILED DESCRIPTION OF CERTAIN PREFERRED EMBODIMENTS

Figure 2:
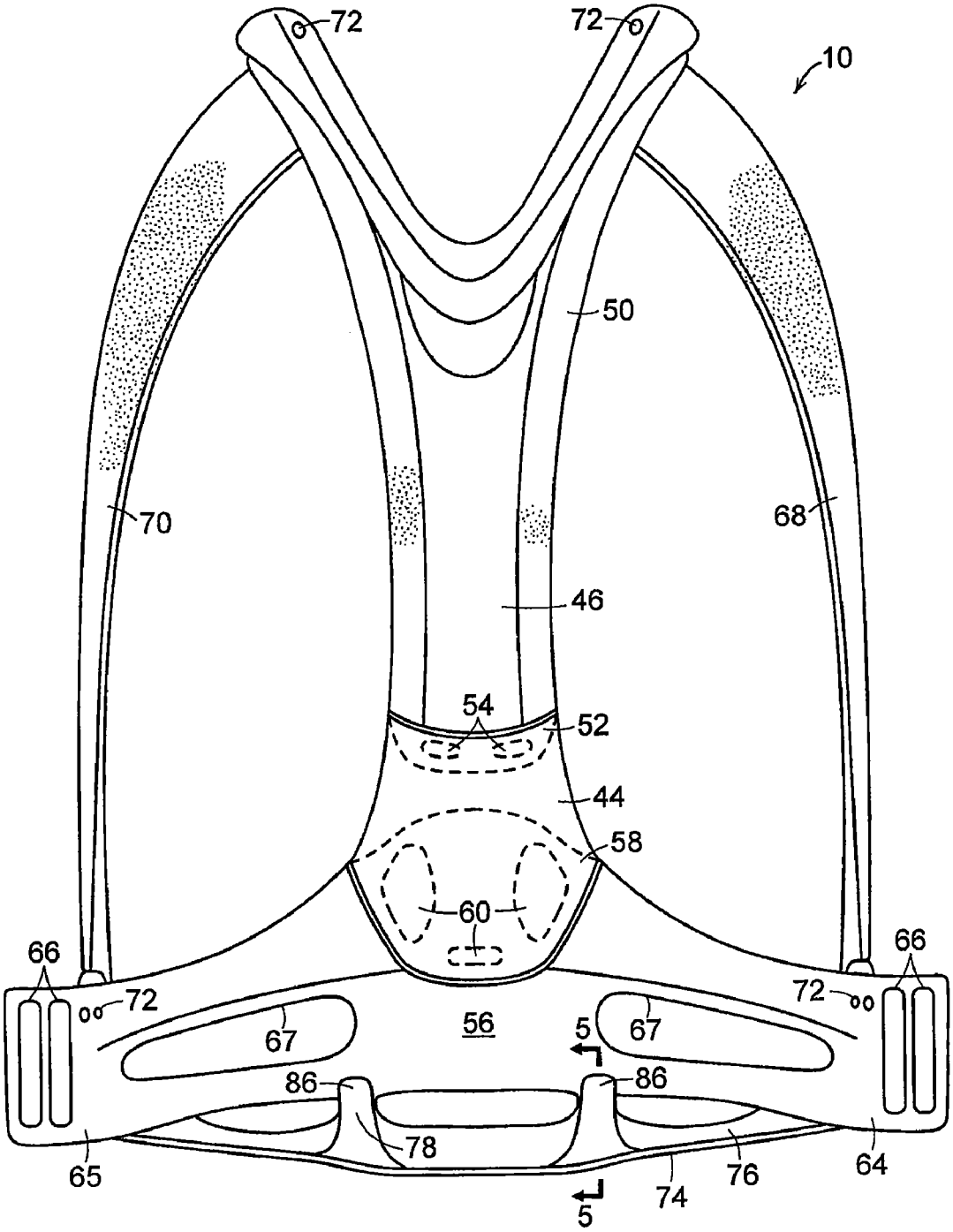
FIG. 2 is an elevation view of the external frame of FIG. 1.

The present invention may be embodied in various forms. A preferred embodiment of an external frame 10 for a backpack 12 is shown in FIGS. 1-2. FIG. 1 illustrates external frame 10 installed on a backpack 12, while FIG. 2 shows external frame 10 by itself. Backpack 12 is formed of a plurality of panels including a top 14, a bottom 16, two lateral sides 18, an outer side 20, and a body side 22. When used herein, the term "outer side" refers to the side of the backpack or other element that faces away from the back of the user wearing the backpack. Accordingly, the term "body side" refers to the side of the backpack or other element that faces the back of a user.

When connected, these six panels or sides define an interior compartment, access to which may be restricted by a zipper 24, or other suitable fastening means. Items such as books, food, clothing, etc. may be placed within the interior compartment. The interior compartment of backpack 12 may be subdivided into compartments, and additional compartments, such as pockets 26 with zippers 28 positioned on outer side 20, may be added in order to keep various items separate from one another, thereby providing easy access to frequently used items, and allowing for the proper weight distribution and comfort to the wearer.

Although six particular sides or panels are described, backpack 12 can comprise fewer or more panels or sides, and be within the scope of the invention. For instance, each of the body, top, bottom, outer, and lateral sides can be comprised of one continuous piece of fabric with no actual seams or junctures. Alternatively, backpack 12 could even be formed with ten or more panels or sides and corresponding seams or junctures therebetween.

The panels making up backpack 12, as well as the straps and other components of the invention, can be formed of a number of natural or synthetic materials. Natural fabrics such as leather, cotton (especially canvas or single-filled duck) and the like may be useful for certain applications. Exemplary materials include synthetic fabrics made from thermoplastic materials such as polypropylene, polyvinyl chloride, polyamide (such as nylon), polyethylene, polyester, etc. In certain preferred embodiments, nylon is used, which can be textured for breathability, wear-resistance, and waterproofed with materials such as silicone elastomers and the like. Particularly useful is a type of nylon known as Cordura (provided by E.I. du Pont de Nemours & Co., Wilmington, Del.). Multiple or composite layer configurations as are well-known in the art, in which a tougher, more durable weave comprises an outer layer while a lighter, thinner, and more flexible inner weave comprises an inner layer. Some of these materials known in the industry, such as Gore-Tex (provided by W.L. Gore & Associates, Newark, Del.), Tri-Shield (provided by Tri-Seal International, Blauvelt, N.Y.), Spandura (provided by H. Warsaw & Sons, New York, N.Y.), etc. can be used as appropriate.

A pair of shoulder straps 30 are secured at first and second ends thereof to backpack 12, with each shoulder strap typically including an adjustable buckle 32. A first or upper end 34 of each shoulder strap 30 is secured to an upper portion of body side 22. In certain embodiments, upper end 34 is secured at the junction of body side 22 and top side 14. In the illustrated embodiment, the configuration of buckle 32 requires shoulder strap 30 to be formed of two pieces. It is to be appreciated that a shoulder strap, or any other strap described herein, such as a hip strap, formed of more than one piece is considered to be, along with any associated buckle or other adjustable fastener, an integral strap within the scope of the present invention.

In a preferred embodiment, hip portions 36 extend outwardly from a lower portion of backpack 12 at the juncture between each lateral side 18 and body side 22. A second or lower end 38 of each shoulder strap 30 is secured to a corresponding hip portion 36, or a lower portion of lateral side 18 in embodiments where there is no hip portion 36, by stitching or other suitable means. A hip strap 40 is secured at opposite ends thereof to external frame 10, with a buckle 42 or other suitable fastener connecting first and second portions of hip strap 40 to one another.

External frame 10 is formed of a plurality of interconnected individual components such that it creates an exoskeleton that extends across outer side 20, and, preferably, lateral sides 18 of backpack 12. External frame 10 may be formed of glass-filled thermal polyurethane, for example. External frame 10 includes a central hub 44 formed of an elastomeric material. Central hub 44 acts as a flexible joint to which other elements of external frame 10 are secured, and about which the other elements flex. Hub 14 may be formed of thermal polyurethane (TPU), or other suitable material that provides some resiliency and flexibility but will return to its original shape, such that the other portions of external frame 10 connected to hub 14 may flex when subject to stresses, allowing significant movement for the various components of external frame 10.

In the illustrated embodiment, an elongate central frame member 46 is secured to backpack 12, a lower end 48 of which is connected to central hub 44. In certain preferred embodiments, central frame member 46 may be substantially Y-shaped. In a preferred embodiment, an upper end 50 of central frame member 46 curves inwardly, along top side 14 toward body side 22 of backpack 12. Central hub 44 may be co-molded about a projection 52 formed on lower end 48. Co-molding provides a strong thermoset chemical bond that securely fastens different parts of external frame 10 together.

Apertures 54 may be formed in projection 52, with two such apertures 54 being illustrated here. When central hub 44 is co-molded with central frame member 46, a portion of central hub extends around projection 52 and through apertures 54, thereby ensuring that lower end 48 is securely held to central hub 44 via a mechanical connection in addition to the chemical bond created with the co-molding process.

A lower frame member 56 extends along a lower portion of outer side 20 and lateral sides 18 of backpack 12, and is connected at a central portion thereof to central hub 44. Central hub 44 may be similarly co-molded about a projection 58 extending from a central portion of lower frame member 56.

A plurality of apertures 60 may be formed in projection 58, allowing central hub to be more securely co-molded with lower frame member 56 as described above with respect to central frame member 46. First and second ends 64, 65 of lower frame member 56 preferably curve outwardly away from lateral sides 18. A pair of slots 66 is formed in first and second ends 64, 65, through which hip strap 40 is woven. An elongate horizontal slot 67 may formed in each side of lower frame member, reducing the mass of external frame 10, while still maintaining its strength and flexibility, and enhancing the aesthetic appeal of the external frame.

A first side support member 68 extends from a top portion of central frame member 46 along a lateral side 18 to first end 64 of lower frame member 56. A second side support member 70 extends from a top portion of central frame member 46 along the opposite lateral side 18 to second end 65 of lower frame member 56. Side support members 68, 70 are secured to central frame member 46 and lower frame member by fasteners 72. Fasteners 72 may be, for example, rivets, screws, or nuts and bolts. Other suitable fasteners will become readily apparent to those skilled in the art, given the benefit of this disclosure.

A resilient support member 74 is secured to an underside of lower frame member 56. Resilient support member 74 is preferably formed of an elastomeric material, such as thermal polyurethane, and is preferably co-molded with lower frame member 56. Resilient support member 74 provides shock absorption and a dampening effect when backpack 12 is placed down on a surface.

Figure 3:
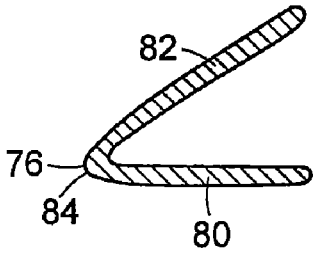
FIG. 3 is a section view, taken along line 3-3 of FIG. 1, of a support member of the external frame.
Figure 4:
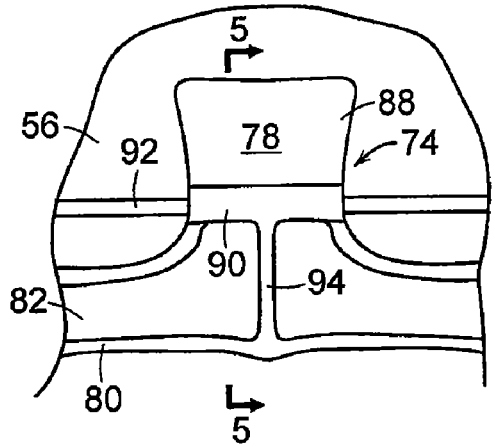
FIG. 4 is an elevation view of the support member of the external frame of FIG. 1.
Figure 5:
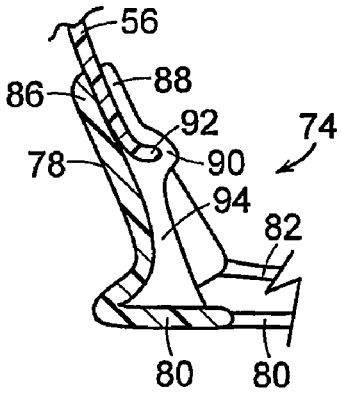
FIG. 5 is a section view, taken along line 5-5 of FIG. 1, showing the support member of the external frame.

As seen most clearly in FIGS. 2-4, resilient support member 74 is formed of a base portion 76 and a pair of upwardly projecting extensions 78. Opposed ends of base portion 76 are secured to a lower surface of lower frame member 56. In a preferred embodiment, base portion 76 could be secured to lower frame member 56 by co-molding. Alternatively, base portion 76 could be secured by other means, such as an adhesive. Extensions 78 are also secured to lower frame member 56 by co-molding or other suitable fastening means.

As seen in FIG. 3, base portion 76 is formed of a first member 80 and a second member 82 connected to an outer edge 84 of first member 80 at an angle such that second member 82 extends upwardly and inwardly. First and second members 80, 82 are preferably substantially planar members.

Extensions 78 have an outer flange 86 that is secured to an outer surface of lower frame member 56 and an inner flange 88 that is secured to an inner surface of lower frame member 56, as can be seen in FIGS. 1, 2, 4 and 5. Outer flange 86 and inner flange 88 may be secured to lower frame member 56 by co-molding or other suitable fastening means. A ridge 90 positioned at a lower end of inner flange 88 captures a lip 92 formed at a lower edge of lower frame member 56. A rib 94 extends vertically within each extension 78 from ridge 90 to first member 80 of base portion 76. Rib 94 flexes when the weight of backpack 12 is placed on support member 74, thereby acting as a mechanical shock absorber. The thickness of rib 94, as well as the other components of support member 74 can be varied in order to provide a desired amount of flexibility, stiffness, and support for external frame 10 of backpack 12. It is to be appreciated that the thickness of the various components of support member 74 need not be constant, and may vary to provide a desired flexibility, stiffness, or other properties at desired locations.

Figure 6:
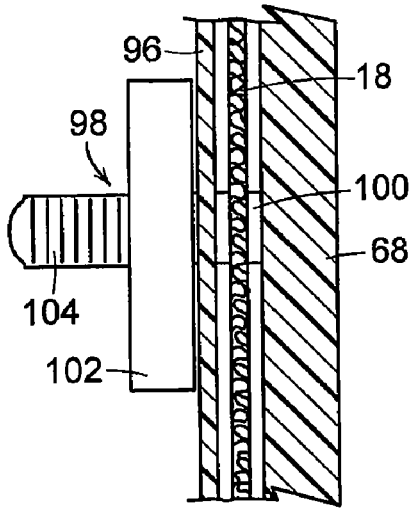
FIG. 6 is a section view, taken along line 6-6 of FIG. 1, showing the external frame secured to a backpack by way of a fastener.

External frame 10 is secured to backpack 12 by way of a fastener 98, as illustrated in FIG. 6, where side support member 68 is shown secured to backpack 12. It is to be appreciated that central frame member 46 and lower frame member 56 are secured to backpack 12 in the same fashion. As illustrated here, a thin sheet 96, preferably formed of plastic, is positioned inside of lateral side 18 in backpack 12. A fastener 98 secures side support member 68 to lateral side 18 and thin sheet 96. Sheet 96 helps to distribute the forces exerted by fastener 98 to a wider area of backpack 12. Additionally, sheet 96 allows the edges of external frame 10 to be maintained in close relationship to backpack 12, resulting in an improved appearance.

In a preferred embodiment, fastener 98 comprises a stud 100 extending in from side support member 68 through lateral side 18 and sheet 96. A cap 102 is secured by threading or in snap-fit manner to a threaded end 104 of stud 100. Other suitable fasteners for securing the members of external frame 10 to backpack 12 will become readily apparent to those skilled in the art, given the benefit of this disclosure.

In light of the foregoing disclosure of the invention and description of the preferred embodiments, those skilled in this area of technology will readily understand that various modifications and adaptations can be made without departing from the scope and spirit of the invention. All such modifications and adaptations are intended to be covered by the following claims.

What is claimed is:

1. A backpack comprising, in combination:

a bag having a body side adjacent a user's back when the backpack is in an in use condition on the shoulders of a user, and an outer side positioned away from the user's body in the in use condition;

a frame having a body side, an outer side opposite the body side, an upper side, and an underside opposite the upper side, the body side and the outer side defining a bottom edge of the frame, the frame extending over and over secured to an exterior surface of the outer side of the bag such that the body side of the frame faces the outer side of the bag and comprising an elastomeric central hub; and a plurality of frame members, each frame member secured to the central hub and extending across a portion of the outer side and formed of a material different than that of the central hub;

a pair of shoulder straps, an upper end of each shoulder strap secured to an upper portion of the body side of the bag and a lower end of each shoulder strap secured to a lower portion of the bag;

a hip strap connected at opposite ends of the frame; and a resilient support member secured to and extending along substantially the entire bottom edge of the frame.

2. The backpack of claim 1, wherein the central hub is formed of thermal polyurethane.

3. The backpack of claim 1, wherein the frame is formed of glass-filled thermal polyurethane.

4. The backpack of claim 1, wherein the central hub is co-molded with the frame.

5. The backpack of claim 1, wherein the central hub and the frame members are secured to the bag with fasteners.

6. The backpack of claim 1, wherein the support member is formed of an elastomeric material.

7. The backpack of claim 1, wherein the support member is formed of thermal polyurethane.

8. The backpack of claim 1, wherein the resilient support member comprises a base portion and at least one upwardly projecting extension.

9. The backpack of claim 8, wherein each extension includes an outer flange secured to an outer surface of the frame and in inner flange secured to an inner surface of the frame.

10. The backpack of claim 9, wherein each extension includes a rib extending from its inner flange to the base portion.

11. A backpack comprising, in combination:

a bag having a body side adjacent a user's back and extending substantially vertically when the backpack is in an in use condition on the shoulders of a user, and an outer side positioned away from the user's body in the in use condition;

a frame having a body side, an outer side opposite the body side, an upper side, and an underside opposite the upper side, the body side and the outer side defining a bottom edge of the frame, the frame extending over and secured to an exterior surface of the outer side of the bag such that the body side of the frame faces the outer side of the bag and comprising a plurality of frame members extending across a portion of the outer side; and a resilient support member secured to and extending along substantially the entire bottom edge of the frame;

a hip strap connected at opposite ends of the frame; and a pair of shoulder straps, an upper end of each shoulder strap secured to an upper portion of the body side of the bag and a lower end of each shoulder strap secured to a lower portion of the bag.

12. The backpack of claim 11, wherein the support member is formed of an elastomeric material.

13. The backpack of claim 11, wherein the support member is formed of thermal polyurethane.

14. The backpack of claim 11, wherein the support member comprises a base portion and at least one upwardly projecting extension.

15. The backpack of claim 14, wherein each extension includes an outer flange secured to an outer surface of the frame and in inner flange secured to an inner surface of the frame.

16. The backpack of claim 15, wherein each extension includes a rib extending from its inner flange to the base portion.

17. A backpack comprising, in combination:

a bag having a body side adjacent a user's back when the backpack is in an in use condition on the shoulders of a user, and an outer side positioned away from the user's body in the in use condition and a pair of hip portions extending from lower portions of the body side;

a frame having a body side, an outer side opposite the body side, an upper side, and an underside opposite the upper side, the body side and the outer side defining a bottom edge of the frame, the frame extending over and secured to an exterior surface of the outer side of the bag such that the body side of the frame faces the outer side of the bag and comprising an elastomeric central hub; and a plurality of frame members, each frame member formed of a different material than the central hub and co-molded to the central hub and extending across a portion of the outer side;

a resilient support member secured to and extending along substantially the entire bottom edge of the frame;

a pair of shoulder straps, an upper end of each shoulder strap secured to an upper portion of the body side of the bag and a lower end of each shoulder strap secured to a lower portion of the bag;

a hip strap connected at opposite ends of the frame.

18. The backpack of claim 17, wherein the central hub is formed of thermal polyurethane.

19. The backpack of claim 17, wherein the frame is formed of glass-filled thermal polyurethane.

20. The backpack of claim 17, wherein the central hub is co-molded with the frame.

21. The backpack of claim 17, wherein the central hub, the central frame member and the lower frame member are secured to the bag with fasteners.

22. The backpack of claim 17, wherein the support member is formed of an elastomeric material.

23. The backpack of claim 17, wherein the support member is formed of thermal polyurethane.

24. The backpack of claim 17, wherein the support member comprises a base portion and at least one upwardly projecting extension.

25. The backpack of claim 24, wherein each extension includes an outer flange secured to an outer surface of the frame and in inner flange secured to an inner surface of the frame.

26. The backpack of claim 25, wherein each extension includes a rib extending from its inner flange to the base portion.

* * * * *

UNITED STATES PATENT AND TRADEMARK OFFICE

CERTIFICATE OF CORRECTION

PATENT NO. : 7,537,143 B1
APPLICATION NO. : 10/682810
DATED : May 26, 2009
INVENTOR(S) : Michael Collier It is certified that error appears in the above-identified patent and that said Letters Patent is hereby corrected as shown below:

Column 6, line 15, replace “over and over” with --over and--.

Column 6, line 48, replace “in inner” with --an inner--.

Column 7, line 18, replace “in inner” with --an inner--.

Column 8, line 30, replace “in inner” with --an inner--.

Signed and Sealed this

Fourth Day of August, 2009

John Doll

JOHN DOLL
*Acting Director of the United States Patent and Trademark Office*